United States Patent [19]

McKinney

[11] Patent Number: 5,067,643

[45] Date of Patent: Nov. 26, 1991

[54] HIP-LEVEL PACK FRAME

[76] Inventor: John McKinney, P.O. Box 96, Coram, Mont. 59913

[21] Appl. No.: 305,781

[22] Filed: Feb. 2, 1989

[51] Int. Cl.[5] ..... A45F 5/00

[52] U.S. Cl. ..... 224/197; 224/211; 224/215; 224/224; 224/226; 224/231

[58] Field of Search ..... 224/197, 195, 199, 209, 224/211, 215, 259, 260, 262, 224, 225, 226, 227, 228, 231

[56] References Cited

U.S. PATENT DOCUMENTS

| | | | |
|---|---|---|---|
| 337,194 | 3/1886 | Poteet | 224/216 |
| 892,991 | 7/1908 | Hepworth | 224/259 |
| 1,207,154 | 12/1916 | Fox | 224/260 |
| 1,601,624 | 9/1926 | Houghton | 224/195 |
| 3,610,487 | 10/1971 | Campos | 224/198 |

FOREIGN PATENT DOCUMENTS

| | | | |
|---|---|---|---|
| 67754 | 4/1944 | Norway | 224/209 |
| 23423 | of 1907 | United Kingdom | 224/197 |

*Primary Examiner*—Linda J. Sholl

*Attorney, Agent, or Firm*—Nutter, McClennen & Fish

[57] ABSTRACT

A hip-level pack or pack frame for minimizing strain on a wearer's back and hips includes a belt arranged to be releasably secured about a wearer's waist. Pivotally connected to the belt at spaced-apart locations therealong is a pair of relatively large bags so that when the belt is secured about the wearer's waist, the bags are supported for free swinging movements at the wearer's hips and have essentially the same orientation when the wearer is upright or bent over. A shoulder harness for supporting some of the weights of the bags and their contents when the wearer is erect also disclosed.

8 Claims, 2 Drawing Sheets

HIP-LEVEL PACK FRAME

This invention relates to a container in the nature of a backpack. It relates more particularly to an improved pack frame designed to be worn at hip level.

BACKGROUND OF THE INVENTION

There are numerous different kinds of packs and pack frames in use to facilitate the carrying of loads on the back and other parts of the body. The pack with which we are concerned here is a so-called hip-level pack which is strapped around the waist like a belt and which includes one or more large bags or containers capable of supporting a relatively heavy load. The hip-level pack is particularly useful when one has to carry a multiplicity of articles for dispensing at different locations.

One obvious potential user of such a pack or pack frame is a paperboy who must carry a supply of rolled-up newspapers and deliver them door-to-door. Obviously, his job is simplified if he can carry a large number of such papers comfortably and yet remain mobile.

Another application which is of special interest here involves the planting of seedlings. After trees are harvested in a particular forest area, seedlings in the form of plugs are planted to provide replacement stock. While these plugs are quite small, it is often necessary for a worker to carry a large number of plugs with him when embarking on a planting operation. This is because the planting sites are often located in relatively inaccessible places remote from the seedling supply such that it would be uneconomical and time-consuming if the worker had to go back and forth frequently to replenish his personal supply of seedlings. Thus, while each seedling might weigh relatively little, it is not unusual for the supply of seedlings carried by a typical worker to weigh in the order of 50 lbs. or more at the beginning of a particular shift.

The most prevalent kind of hip-level pack in use today is shown generally at P in FIG. 1. It consists of a flexible belt B which is arranged to strap around the waist of the worker W. Attached to the section of the belt that extends around the worker's hips and back is a pair of relatively large flexible containers or bags $P_1$ and $P_2$ When the worker starts a shift, he fills the bags $P_1$ and $P_2$ with a multiplicity of seedlings S so that total weight of each bag and its contents can be as much as 25 lbs. At the planting site, the worker reaches back and withdraws seedlings S from the bags and, while bending over as shown in FIG. 1, digs holes in the ground and plugs the seedlings into the holes. Thus in the process of planting the seedlings, the worker must walk from place to place and constantly bend over and straighten up. When the worker is walking, he often has to jump or step over obstacles in his path. This action causes the pack P to bounce up and down placing considerable strain on the worker's hips and spine. Also, when the worker bends over, the pack P swings up as shown in FIG. 1 transferring the seedling load to the wearer's back and spine which over time causes additional fatigue and physical distress. In fact, people working in this field acquire a variety of orthopedic problems traceable directly to the way in which these heavy loads are carried on their bodies.

It would be desirable, therefore, to be able to provide a hip-level pack or pack frame which is relatively comfortable to wear and which distributes its load on the wearer's body so as to minimize orthopedic problems and yet which does not materially decrease the wearer's mobility and working efficiency.

SUMMARY OF THE INVENTION

It is an object of the present invention to provide an improved hip-level pack or pack frame.

Another object of the invention is to provide such a pack which enables the wearer to support relatively heavy loads comfortably.

Another object of the invention is to provide a pack of this type which reduces the strain on the wearer's back and spine caused by the weight of the pack and its contents.

Yet another object of the invention is to provide a hip-level pack which does not appreciably reduce the mobility of the wearer.

A further object of the invention is to provide a hip-level pack which transfers its load to the wearer's body in more or less the same way whether the wearer is standing up or bending over.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, my hip-level pack comprises a belt or harness arranged to strap around the wearer's waist. Pivotally connected to the belt or harness at the wearer's hips are a pair of relatively large containers or bags for containing a supply of articles such as seedlings, for example. The pivots allow the weight of the bags and their contents to transfer evenly to the wearer's hips.

The bags are held at the desired angle by the ballast of the load, with the load centers of gravity being located well below the pivots. With the load balanced thusly, the wearer is free to bend and move about without any appreciable strain to the spine as would occur if the containers were strapped directly to the wearer's waist as depicted in FIG. 1. The balanced weight transfer to the wearer's body also keeps the belt or harness from binding and digging into the body opposite the load. With this arrangement, the body is free to bend independently of the load which remains substantially stationary while the belt or harness pivots with the body.

In one preferred embodiment of the invention, shoulder straps connect directly to the load bearing pivots to the bags such that the straps help to support the load, but only when the wearer is in an upright position. On the other hand, when the wearer bends over, the distances between the tops of his shoulders and his hips where the pivots are located become shorter allowing the straps to slacken so that their shares of the burden settle onto the belt around the wearer's waist. This unloading of the shoulder when the wearer bends over eases back strain. It also minimizes rubbing and chafing of the straps against the wearer's shoulders and back.

My hip-level pack with its superior load transfer properties should reduce considerably the fatigue and physical distress caused to workers who are required by the nature of their work to carry heavy loads from place to place and particularly to those who are required to repeatedly bend over in the course of their work. Yet the pack is composed of a relatively few number of inexpensive parts which are easy to make and to assemble. Therefore, the cost of the pack should not be appreciably more than that of prior comparable hip-level packs of this general type which do not possess the above advantages.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 2:
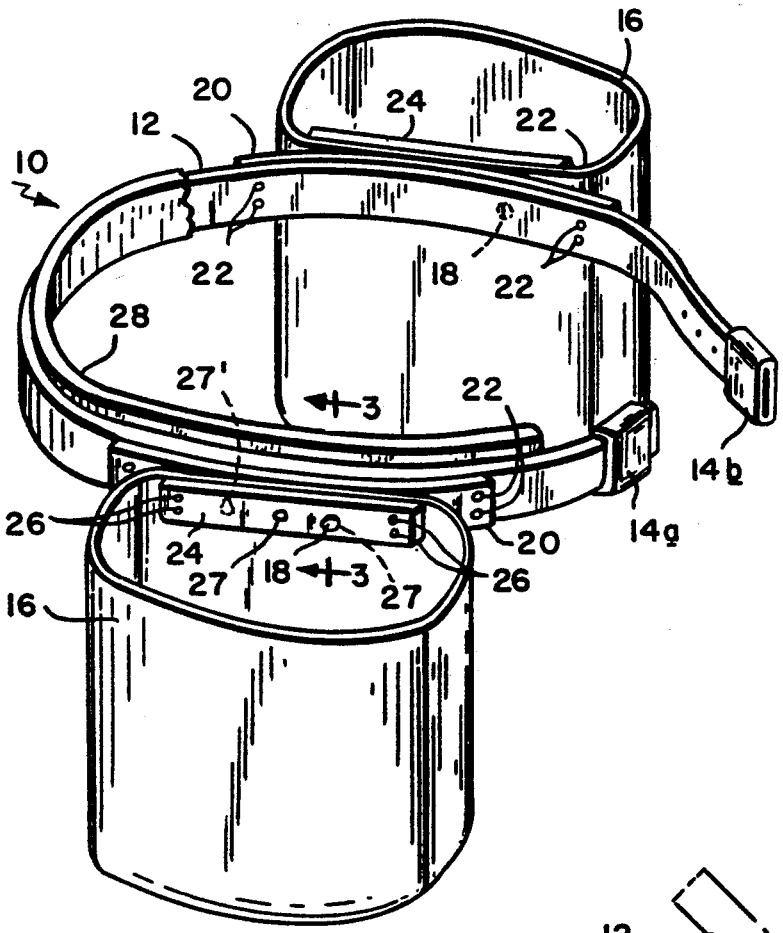
FIG. 2 is an isometric view on a larger scale showing a hip level pack embodying my invention.

Referring to FIG. 2 of the drawings, my improved hip-level pack or pack frame is shown generally at 10. It comprises a flexible belt 12 made of webbing or other suitable strong flexible material. Mounted to the opposite ends of belt 12 are a pair of mating buckle sections 14*a* and 14*b* which are arranged to couple or snap together. Suspended from each side of belt 12 is a pair of relatively large containers or bags 16 made of a suitable rugged material such as canvas. Each bag 16 is pivotally connected to belt 12 by a pivot pin 18 so that the bag hangs down below belt 12 at a selected angle depending upon the location of the pivot pin 18 and the center of gravity of the bag 16 and its contents.

Figure 3:
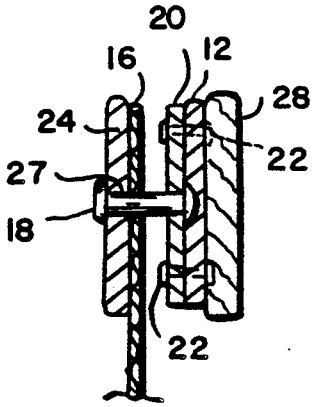
FIG. 3 is a sectional view along line 3—3 of FIG. 2.

Referring now to FIGS. 2 and 3, to provide reinforcement, a pair of relatively stiff curved straps 20 made of metal or a suitable plastic material such as polyethylene is positioned at opposite sides of belt 12 in the vicinity of pivot pins 18. The illustrated straps 20 are about 8 inches long and slightly narrower than belt 12. They are mounted to the outside surface of the belt with their opposite ends being anchored to the belt by rivets 22. A flat strap 24 made of a similar material is mounted to the inside edge margin of each bag 16, the opposite ends of that strap being anchored to the associated bag by rivets 26. In addition to reinforcing the bag in the vicinity of its pivot pin 18, strap 24 also tends to support the bag so that its mouth remains open thereby forming a readily accessible pocket.

As best seen in FIG. 3, each pivot pin 18 extends through aligned holes 27 in strap 20, the bag 16 inside wall and strap 24, the head 18*a* of the pin being positioned under belt 12 so that it is out of the way of the wearer. The length of the pin 18 is greater than the combined thickness of the straps 20 and 24 and the bag 16 wall so that there is an appreciable gap between the bag 16 wall and strap 20 enabling the bag 16 to swing freely with respect to the belt 12. Preferably, a pad 28 extends around the inside surface of belt 12 at the back and sides of the belt to provide added comfort to the wearer.

Figure 4:
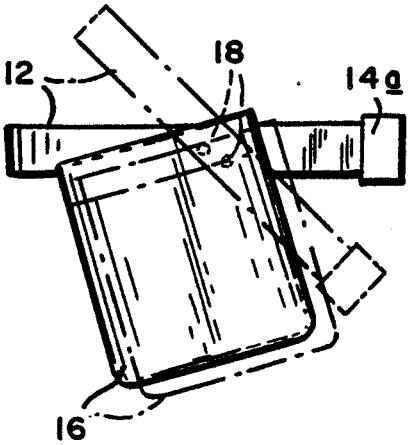
FIG. 4 is a diagrammatic view illustrating the operation of the FIG. 2 pack.

Refer now to FIG. 4. When the belt 12 is horizontal as shown in solid lines in that figure, as it would be if the wearer were standing upright, each bag 16 hangs down at an angle that depends upon the location of its pivot pin 18 along the bag strap 24.

Preferably, several holes 27 are spaced along stop 24 (and the bag wall) as shown in FIG. 2 so that the location of the pivot pin along the strap may be selected to give the bag a forward tilt, a rearward tilt or no tilt. In this connection, each hole 27 in each strap 24 can be shaped as a key hole as indicated in phantom at 27' in FIG. 2 so that each bag 16 can be detached quickly from belt 12.

When the pack 10 is being used to transport seedlings, each pivot pin 18 is usually placed so that the opening into the associated bag is tilted slightly rearwardly as shown in FIG. 4. With this arrangement, seedlings projecting from the tops of the bags will extend up behind the worker's arms so that they do not interfere with the arm and shoulder movements of the worker while he is walking and planting.

Figure 1:
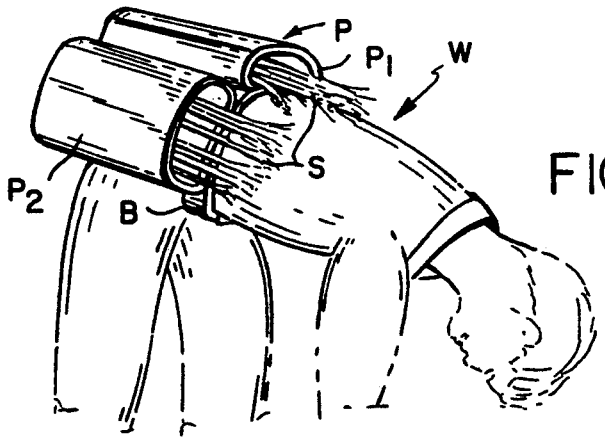
FIG. 1 PRIOR ART
FIG. 1, already described, illustrates the common conventional type of hip-level pack.

When the worker bends over, the belt 12 tilts with the wearer's waist as shown in phantom in FIG. 4. However, since each bag 16 is connected to the belt by a pivot pin 18 and since the center of gravity of each bag and its contents is located well below the pivot pin, the bag will shift only slightly and will not change its orientation at all as shown in phantom in FIG. 4. Thus the load of the bags and their contents will be transferred to the wearer's hips in substantially the same way as when the worker stands upright. Assuming that the worker empties bags 16 at substantially the same rate, the pack 10 will remain balanced on the wearer's body so that there is a minimal amount of chafing or rubbing against the worker's hips as he walks along and plants the seedlings. Most importantly, when the worker bends over, the bags 16 and their contents are not hoisted up onto the worker's back as is the case with the conventional pack P shown in FIG. 1. Resultantly, even prolonged usage of pack 10 does not cause discomfort or physical distress to the worker. On the contrary, the worker is free to bend and move about without any appreciable strain to the back and spine. Since the body is free to bend independently of the load which remains stationary, there is substantially no conversion of the compression load on the wearer's hips and legs to a bending load on the wearer's back and spine. Thus the wearer of pack 10 should suffer materially fewer orthopedic problems than a wearer of the conventional pack P described at the outset.

Figure 5:
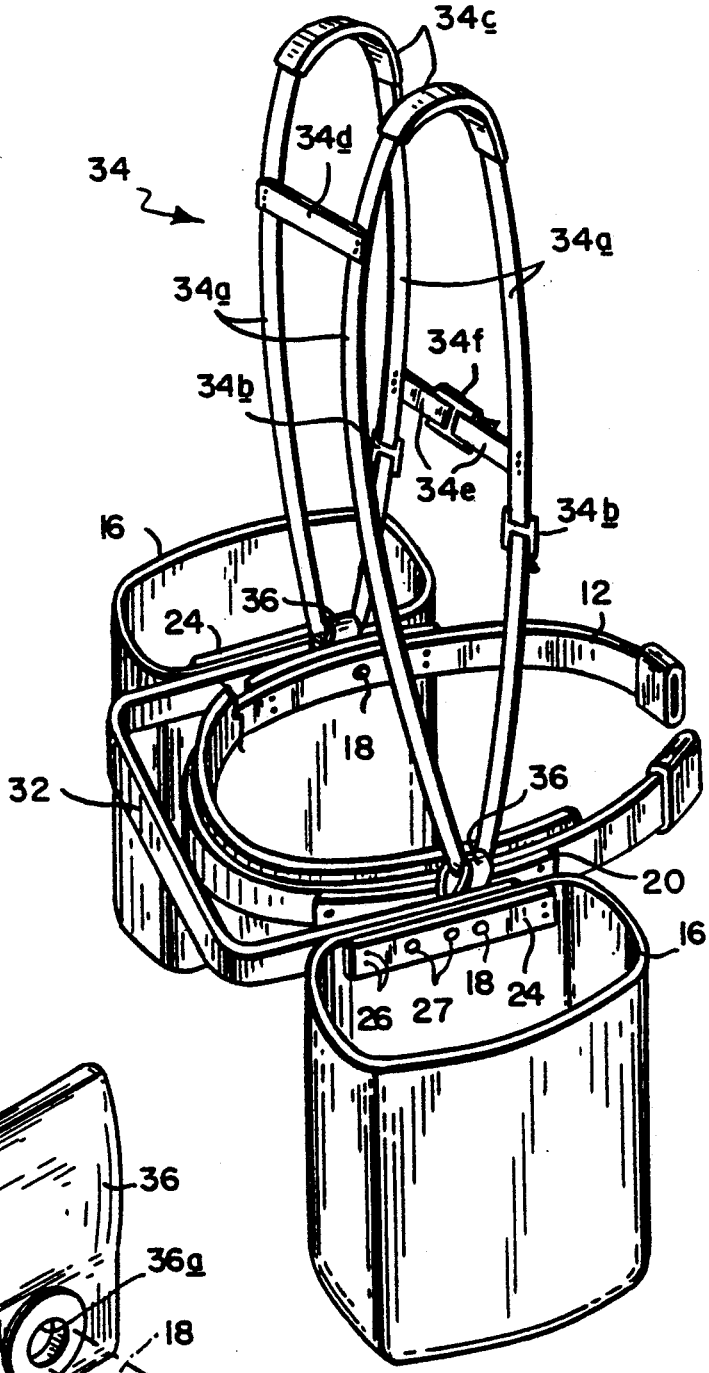
FIG. 5 is a view similar to FIG. 2 showing another embodiment of my invention.
Figure 5A:
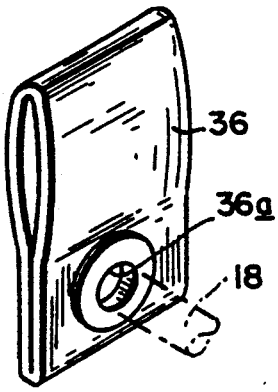
FIG. 5A is a close up view of the loop for the snap enders.

Refer now to FIG. 5 which illustrates another pack embodiment shown generally at 30 which is particularly adapted to support heavy loads. Pack 30 is similar in many respects to pack 10 described above and therefore the common elements bear the same identifying numerals. Pack 30 differs from pack 10 primarily in incorporating a frame member 32 and suspenders shown generally at 34 which are arranged to engage over the wearer's shoulders to help support the weight of the bag 16 and their contents when the wearer is standing upright and/or walking.

As shown in FIG. 5, the frame 32 is a rigid, generally U-shaped member whose opposite ends are anchored to the bag straps 24 preferably by the same rivets 26 that anchor the straps to the bag walls. Frame 32 extends around the wearer's back with appreciable clearance so that it does not engage or rub against the wearer's posterior. Preferably, the frame is made of a relatively lightweight material such as aluminum metal or a plastic. Frame 32 interconnects the two bags 16 so that the bags both have the same orientation when the wearer is walking, bending or otherwise moving about. It helps to assure that the loads supported at the opposite sides of the wearer are transferred in the same way and symmetrically to the wearer's hips to further minimize fatigue and physical distress to the wearer.

Still referring to FIG. 5, the set of suspenders 34 is more or less conventional. It comprises a pair of relatively long, inextensible flexible straps 34a whose ends are releasably secured together by buckles 34b to form loops. Pads 34c are present at the upper ends of the strap loops to provide wearer comfort. The belt stretches which would normally be at the wearer's back, are connected together by a short strap segment 34d. In a similar fashion, the strap stretches that normally extend down over the wearer's chest are releasably connected together by a two-piece strap 34e whose free ends are releasably connected together by a snap buckle 34f. The suspenders 34 are secured to the pack frame by passing the lower end of each strap 34a loop through fabric eyelets or loops 36 having grommets 36a that are loosely engaged on the pivot pins 18 between the straps 20 and 24 thereat.

In order to put on the pack 30, prior to buckling belt 12, with the buckle 34f uncoupled, the wearer places straps 34a over his back and shoulders so that the pads 34c rest on the shoulders. Then he secures the buckle 34f at the front of straps 34a and buckles the belt 12 and draws the straps 34a through the buckles 34b until the suspenders are relatively tight.

As shown in FIG. 5, the shoulder straps 34a connect directly to the load bearing pivot pins 18 by way of loops 36 and share the loads in bags 16 when the wearer is standing or walking in an upright position. However, when the wearer bends over as when planting a seedling, the distance between the tops of the shoulders and the hips becomes shorter. Resultantly, the straps 34a become slack and their shares of the load settle onto the hip belt 12. This unloading of the shoulders when bending reduces the chance of back strain and prevents the straps from rubbing or chafing against the wearer's back and shoulders as he bends over and straightens up. Yet, when the worker is walking upright, the suspenders 34 take weight off the hips so that good blood circulation to the legs is maintained when the worker is walking with heavy loads in bags 16.

It will be appreciated from the foregoing that my improved hip-level pack or pack frame greatly facilitates the carrying of heavy loads, particularly those made up of a multiplicity of individual articles that have to be distributed by the pack wearer. The pack frame described herein does not interfere with the wearer's mobility and it allows him to bend over without imposing any appreciable strain on the back and hips due to the pack load. Yet the pack is composed of a relatively few parts that can be manufactured in quantity at a cost that is comparable to the cost of conventional packs of this general type which do not possess the advantages described above. Accordingly, the pack should prove quite beneficial, particularly for tree planting and other such applications that require a worker to assume a variety of different positions while utilizing the contents of the pack.

It will thus be seen that the objects set forth above, among those made apparent from the preceding description, are efficiently attained and since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

I claim:

1. A hip-level pack comprising a belt arranged to be releasably secured about a wearer's waist;

a plurality of relatively large bags positioned along the belt on both sides of the wearer so that loads carried in said bags may be balanced;

a generally U-shaped frame member for extending around the wearer's back outboard of said belt;

means for pivotally connecting an upper margin of each bag individually about pins aligned with and disposed from the wearer's hips and axially fixed to the belt so that when the belt is secured about the wearer's waist, each bag is supported for free swinging movement about each pin individually relative to the belt and the wearer's hips, and means for securing the opposite edges of said frame member to said pair of connecting means.

2. The pack defined in claim 1 wherein said connecting means comprise a first relatively stiff strap positioned against said margin of each bag;

means for anchoring each said first strap to the associated bag margin;

a second relatively stiff strap positioned against the belt directly opposite each said bag margin;

means for anchoring each said second strap to the belt; and pivot means loosely linking each pair of opposing first and second straps.

3. The pack defined in claim 2 wherein the pivot means supporting each bag are positioned along the corresponding first strap so that bag under the influence of gravity is suspended at a selected orientation relative to said belt and second strap.

4. The pack defined in claim 1 and further including suspenders, said suspenders comprising a pair of flexible elongated strap loops;

means for linking the loop lower ends to said belt at said connecting means, the upper ends of said loops being arranged to engage over the wearer's shoulders when said belt is secured about the wearer's waist whereby the weights of said pair of bags and their contents are partially supported by the suspenders when the wearer is in an upright position, said strap loops slackening when the wearer bends over so that the entire weights of said pair of bags and their contents are supported by said belt.

5. The pack defined in claim 4 and further including means for adjusting the length of said strap loops.

6. The pack defined in claim 4 and further including means for connecting said strap loops together at the back of said wearer, and means for releasably connecting said strap loops together at the front of the wearer.

7. The pack defined in claim 4 wherein each of said linking means include an eyelet loosely secured to said connecting means, the lower ends of said strap loops being looped through said eyelets.

8. The pack defined in claim 2 wherein said pivot means is releasable from at least one of said straps.

* * * * *